US010180312B2

(12) United States Patent
Asbill

(10) Patent No.: US 10,180,312 B2
(45) Date of Patent: Jan. 15, 2019

(54) MECHANICAL EXPANDING BROAD HEAD ARROW POINT

(71) Applicant: Jansen Asbill, Mahomet, IL (US)

(72) Inventor: Jansen Asbill, Mahomet, IL (US)

( * ) Notice: Subject to any disclaimer, the term of this patent is extended or adjusted under 35 U.S.C. 154(b) by 0 days.

(21) Appl. No.: 14/614,313

(22) Filed: Feb. 4, 2015

(65) Prior Publication Data

US 2016/0033243 A1 Feb. 4, 2016

Related U.S. Application Data

(60) Provisional application No. 61/935,666, filed on Feb. 4, 2014.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 5,112,063 | A | 5/1992 | Ruckett | |
| 5,322,297 | A | 6/1994 | Smith | |
| 5,636,846 | A | 6/1997 | Tinsley | |
| 5,879,252 | A | 3/1999 | Johnson | |
| 6,200,237 | B1 | 3/2001 | Barrie | |
| 6,726,581 | B2 | 4/2004 | Muller | |
| 7,713,151 | B2 * | 5/2010 | Fulton | F42B 6/08 473/583 |
| 7,905,802 | B2 | 3/2011 | Erhard | |
| 8,029,392 | B2 | 10/2011 | Bolen, III | |
| 8,382,617 | B2 | 2/2013 | Davis | |
| 8,393,983 | B1 | 3/2013 | Sanford | |
| 8,469,843 | B2 | 6/2013 | Mizek et al. | |
| 8,496,550 | B2 | 7/2013 | Zeren | |
| 8,512,179 | B2 | 8/2013 | Pulkrabek et al. | |
| RE44,474 | E | 9/2013 | Vandewater | |

* cited by examiner

*Primary Examiner* — John Ricci

(57) ABSTRACT

An arrowhead exhibiting a flexible shaft allowing the arrowhead to deform around resistant target material, further allowing the blades to alternately deploy and fold based on the resistance of the target material.

14 Claims, 6 Drawing Sheets

MECHANICAL EXPANDING BROAD HEAD ARROW POINT

CROSS-REFERENCE TO RELATED APPLICATIONS

This application claims the benefit of Provisional Patent Application Ser. No. 61/935,666 filed Feb. 4, 2014 by the present inventor, which is incorporated by reference.

BACKGROUND

Figure 1:
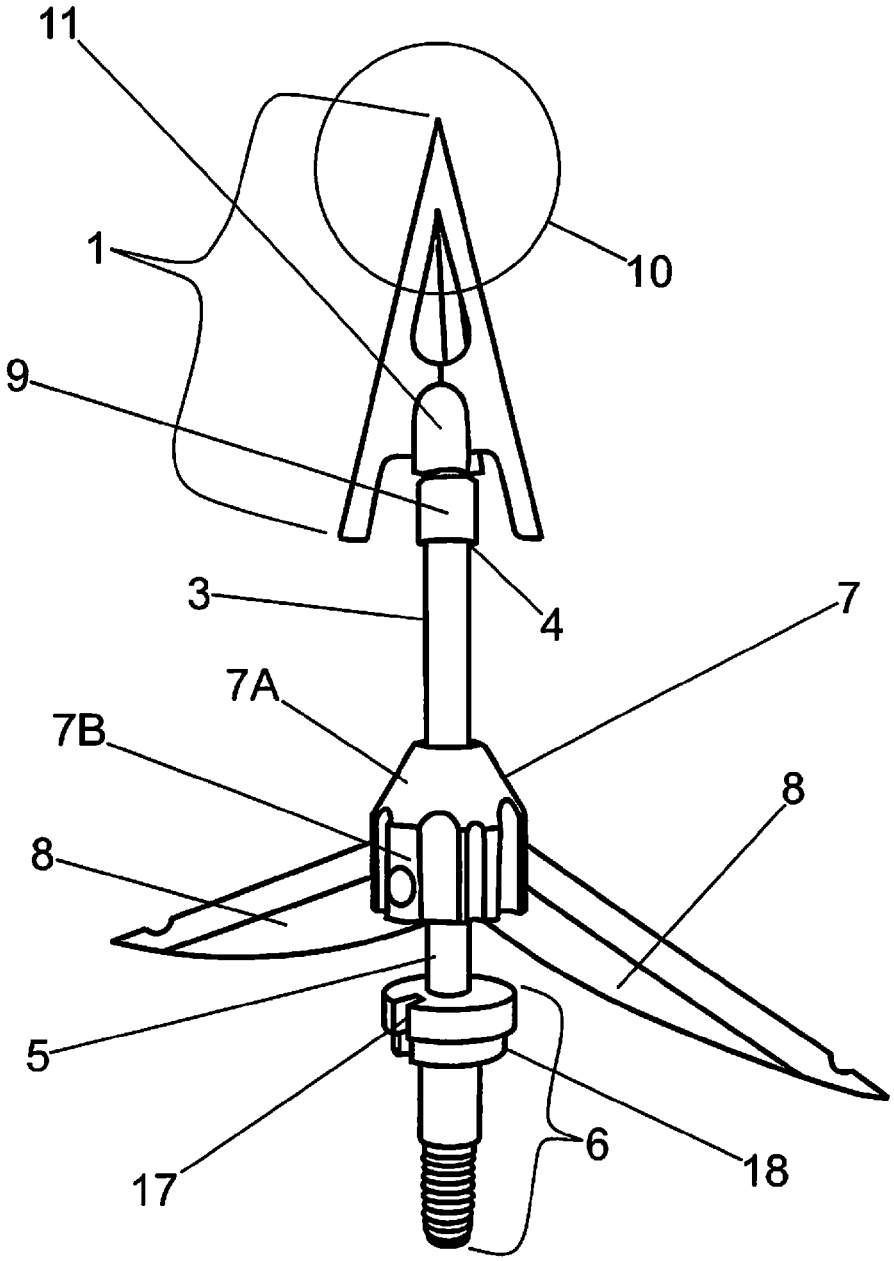
FIG. 1 is a side view of the arrowhead with blades in a partially deployed position.

The use of the bow and arrow is traced to the Upper Paleolithic or Late Stone Age from between 50,000 and 10,000 years ago. At the onset of the Late Stone Age there was a marked increase in the diversity of artifacts including projectile points. The diversity of projectile points indicated the desire to increase the efficiency of the projectile, since mankind's survival depended on his ability to hunt and bring down game. This consistent effort to improve the efficiency of projectile points extends to this day.

The killing efficiency of an arrow point is a function of its ability to penetrate the target and to deliver a wide cutting edge in order to cleanly sever major blood vessels and organs. The wide cutting edge was originally seen in the fixed blade version of the broad head arrow type. However, those types of broad heads were subject to cross winds diminishing accuracy. As a result, broad heads with folding blades began to be developed recognizing the aerodynamic advantages. The term "target" is used in this application to refer to any material the arrowhead may encounter. The greater the penetration, the greater the damage and the more quickly the animal succumbs. The prior art uniformly attempts to solve the problem of penetration by merely using a sharpened point and relying on the kinetic energy imparted by the bow which dissipates upon entering the target. This can be seen in U.S. Pat. No. 5,322,297 to Smith. Here, a standard point is utilized for initial penetration but no function is described that would enhance target penetration after the arrow head enters the target by preserving kinetic energy. Slots are used in both Smith and U.S. Pat. No. 6,200,237 B1 to Barrie, in which the proximal edge of the blades ride during deployment. After deployment, an open slot remains in front of the proximal edge of the blades which is susceptible to clogging with animal hair, fat and muscle. This may prevent the blades from folding and redeploying. In the prior art, the blades when in the folded position rest perpendicular and on top of the shafts, allowing aerodynamic interference. Barrie also utilized a standard point but does not indicate any aspect that would help preserve kinetic energy as the arrow travels through the target and offers no suggestion of a mechanism to overcome the problem of deflecting around or penetrating through resistant target material such as bone and cartilage which is the most common cause of poor penetration. Further the sliding body, (blade carrier in the applicant's embodiment) of Barrie has a stepped leading edge and will not allow blunt force impact. The prior art also discloses blades that when in the folded flight position, extend to some degree beyond the body of the arrowhead. This allows for aerodynamic interference from flight itself and from cross winds. The embodiment herein described recognizes that penetration can be maximized with utilization of the described design and material components.

ADVANTAGES

There are several advantages in utilizing a resilient shaft such as a carbon fiber rod to which the point is attached. When impacting a target such as an animal, the arrowhead will encounter solid structures such as bone and cartilage. These structures are the single most important factor in the loss of kinetic energy and thus a loss of penetration. A flexible shaft will deflect and flex around such structures yet due to its resiliency will return to its original linear shape. The prior art is composed of material, mainly steel or aluminum, that, if deformed will remain deformed. Many of the deployable blades seen in the prior art are capable of deploying only when their attachment collar moves rearward on a shaft. If the shaft is bent, this is not possible. In the described embodiment, the carbon fiber shaft returns to its original shape and then allows the blade carrier to freely slide up and down the carbon fiber shaft avoiding interference with the deployment and folding of the blades. That is, in traditional arrow points where the shaft is bent, the blades that have been deployed will either remain in a deployed position preventing the arrowhead from passing the bone and reducing or stopping penetration, or will remain in a folded position diminishing the cutting function.

When the arrowhead passes the obstruction, the deployed blades will naturally fold inward and force the attachment collar forward. With a flexible shaft, once the obstruction is passed the blades may redeploy and begin their cutting function once again. The ability to collapse and reopen allows the blades to pass around denser objects such as bone or cartilage or through ribs, then redeploy again in soft tissues achieving maximum damage and lethality.

Another advantage of this embodiment is the ability of the blade carrier to rotate freely around the smooth carbon fiber shaft. Depending on the angle at which an obstruction is encountered the ability of the blades and blade carrier to rotate results in blade movement that will allow the arrowhead to deflect or twist around bone or other resistant target material.

The ogive, shoulder or curved aspect of the leading portion of the blade carrier works in conjunction with the tri-bladed tip. The tri-bladed tip opens a triangular path through the target. If a four bladed tip would be employed a square path would be created. This allows the blade carrier to penetrate the target material yet allows enough rearward pressure to be created by the target material on the blade carrier to fully deploy the blades. The radius of the ogive is predetermined to allow the maximum blunt force impact should bone be directly encountered and deflection is not possible as in the case of a shoulder blade. The blunt force will penetrate the bone by applying blunt force. Due to the radius of the ogive, an outward or expanding force is also applied further opening a hole in the bone allowing the arrowhead to pass through with a minimum loss of kinetic energy.

Because of the preservation of kinetic energy during the path of the arrowhead through the target, blades with a larger blades with a longer cutting surface may be employed. Greater cutting surface increases the damage resulting in a quicker and more humane kill.

The utilization of a smooth shaft as opposed to a slotted shaft will prevent animal hair, bone and muscle from being lodged there in thereby preventing the blades from folding and redeploying. The utilization of a bland carrier that is substantially the same as the point width but large enough for the blades to be folded and ride behind the body of the blade carrier allows further aerodynamic stability and penetrating power. Allowing the blades to fold lateral to the flexible shaft as opposed to folding against and on top of the shaft allows the blades to fold more closely to the shaft and to adopt a more aerodynamically efficient flight profile.

DESCRIPTION OF AN EMBODIMENT

| Component List | |
|---|---|
| 1. | Arrowhead |
| 2. | Point |
| 3. | Resilient Shaft |
| 4. | First Resilient Shaft End |
| 5. | Second Resilient Shaft End |
| 6. | Base |
| 7. | Blade Carrier |
| 7A. | Ogive |
| 7B. | Blade Carrier Body |
| 8. | Cutting Blade |
| 9. | Threaded Ferrule |
| 10. | Point Cutting Blades |
| 11. | Threaded Socket |
| 12. | Base Head |
| 13. | Base Shaft |
| 14. | Base Shaft First End |
| 15. | Base Shaft Second End |
| 16. | Arrow Attachment Section |
| 17. | Blade Retention Slot |
| 18. | Blade Retention Band Groove |
| 19. | Blade Retention Band |
| 20. | Blade Carrier Central Bore |
| 21. | Blade Mounting Slots |
| 21A. | Blade Mounting Slot Sidewall |
| 22. | Roll Pin |
| 22A. | Pin Bore |
| 23. | Cutting Blade First End |
| 24. | Cutting Blade Second End |
| 25. | Cutting Edge |
| 26. | Spine |
| 27. | Blade Retention Band Slot |
| 28. | Pivot Hole |

Referring now to the figures, FIG. 1 illustrates the arrowhead 1 in a partially deployed position. The point 2 is comprised of a plurality of blades which are attached to threaded socket 11. In another embodiment the socket 11 could be smooth allowing a smooth ferrule 9 to inserted and affixed therein with adhesive. The ferrule will be composed of a material capable of having threads such as steel. Here FIG. 1 shows a three blade configuration of the point 2, each blade being offset from the adjacent blade by 120°. Internally threaded socket 11 is disposed over externally threaded point attachment mechanism 9, here a treaded ferrule. The threaded ferrule 9 is attached to the resilient shaft 3 composed of carbon fiber or other equally resilient material. Resilient shaft 3 is disposed through blade carrier 7 allowing blade carrier 7 to move up and down resilient shaft 3. A plurality of cutting blades 8 are each pivotally mounted in blade carrier 7. Resilient shaft 3 is disposed within base 6. This could be disposed by virtue of either a threaded or smooth configuration using adhesive.

Figure 2:
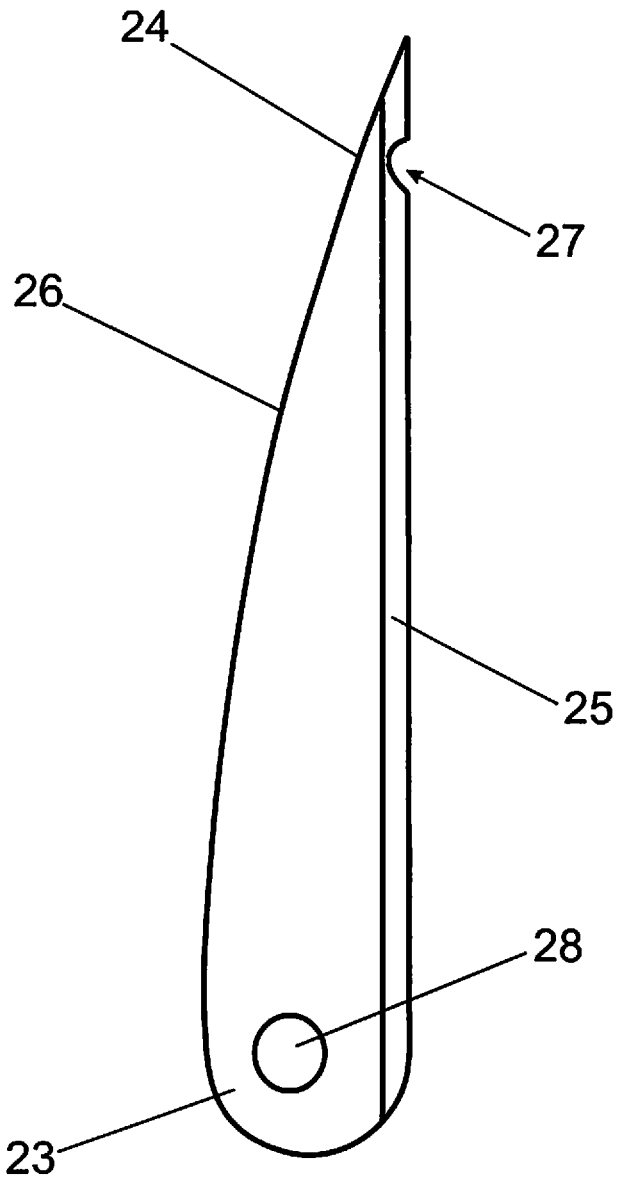
FIG. 2 is a side view of a cutting blade.

Turning now to FIG. 2, a cutting blade 8 is illustrated. The cutting blade will be composed of a metal capable of being honed to a sharp edge such as surgical steel. The cutting blade exhibits a cutting blade first end 23 containing a pivot hole 28. Near the cutting blade second end 24, cutting-edge 25 is notched creating blade retention band slot 27. Cutting blade 8 exhibits cutting edge 25 which, when deployed, is oriented toward the direction of flight of the arrow 1 so that the cutting edge will be deployed against the target material. It is apparent that cutting-edge 25 will then be the first portion of cutting blade 8 to encounter the target material imparting a cutting action. Opposite cutting-edge 26 is spine 26.

Figure 3:
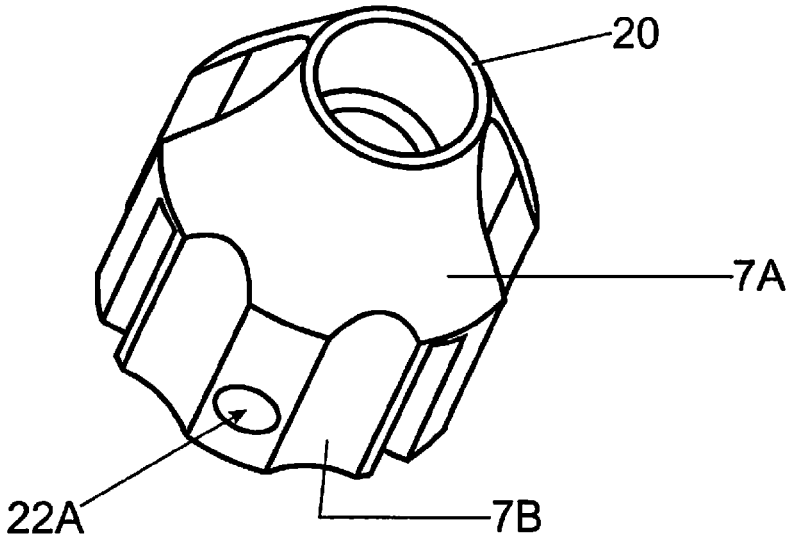
FIG. 3 is a perspective view of the blade carrier.
Figure 3:
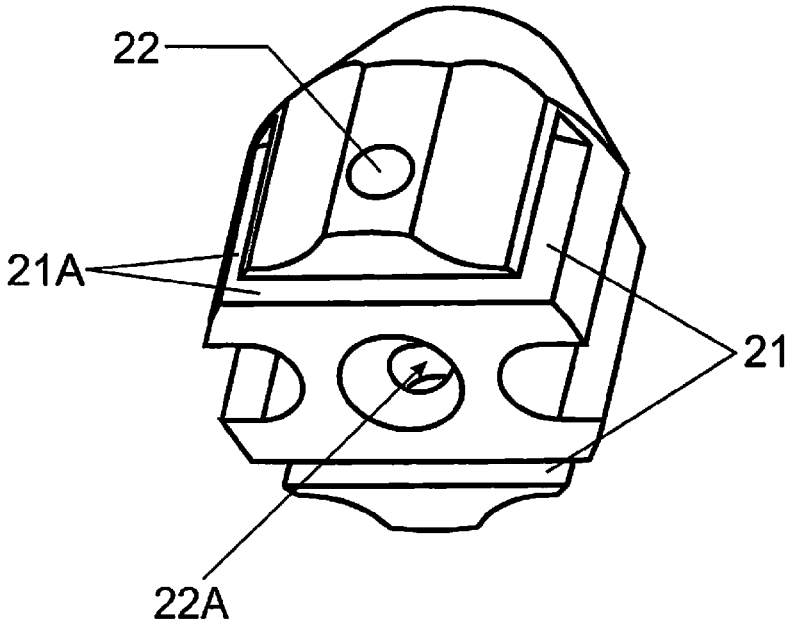

The blade carrier 7 is further illustrated in FIG. 3. The blade carrier 7 is disposed over resilient shaft 3. Resilient shaft 3 extends through blade carrier central bore 20. Blade carrier 7 may bus move freely up and down the resilient shaft 3, aided by the fact that in an embodiment, the shaft is composed of carbon fiber that has self-lubricating characteristics. Blade carrier 7 exhibits a plurality of blade mounting slots 21. In this configuration, two blade mounting slots 21 are shown being milled parallel and opposite to one another and lateral to the blade carrier central bore 20. Of course the blade carrier is composed of a material capable of having slots placed therein such as steel or aluminum. Cutting blade first end 8 is fitted into a blade mounting slot 21. Pivot hole 28 is aligned with the role pin bore 22A and role pin 22 is inserted allowing the cutting blade to rotate. Cutting blade 8 is inserted within blade mounting slot 21 such that when the cutting blade 8 is extended, cutting edge 25 will have contact with the target material. Blade carrier 7 also exhibits an ogive 7A. The term "ogive" is used in the manner seen in ballistics when describing the components of a bullet and refers to the angle of curvature or radius exhibited from the blade carrier body 7B to the edge of the blade carrier central bore 20. The curvature of the ogive is predetermined to provide the maximum blunt force impact in light of the maximum desirable outward or expanding force.

Figure 4:
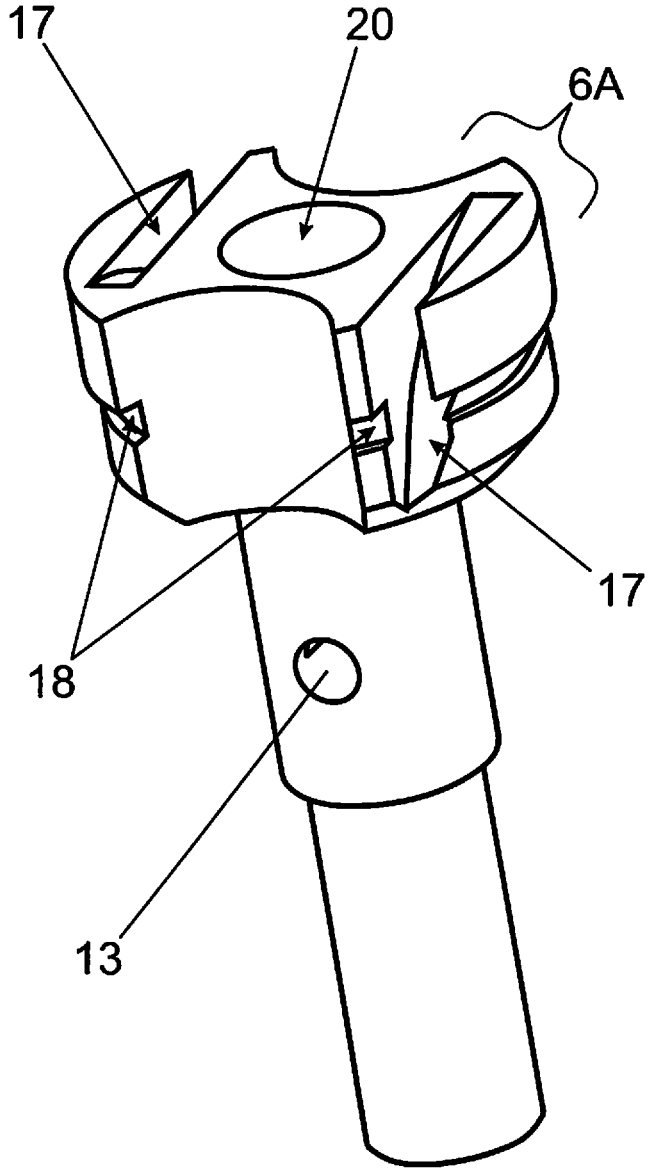
FIG. 4 is a perspective view of the base.

FIG. 4 illustrates base 6. Base 6 exhibits a base central bore 20 that receives the resilient shaft 3. Base head 6A exhibits a plurality of blade retention slots 17. The blade retention slots 17 are located lateral to base central bore 20. When the cutting blade 8 is rotated toward resilient shaft 3, blade carrier 7 may be turned such that spine 26 of cutting blade second end 24 rests within blade retention slots 17. When this configuration is adopted it is apparent that the cutting blade retention slot is now oriented directly opposite blade mounting slots 21 milled into blade carrier 7. Base head 6A also exhibits blade retention band groove 18. The blade retention slots are milled within the base head 6A at a predetermined angle to allow smooth deployment of blades 8 when target material forces blade carrier 7 rearward.

Figure 5:
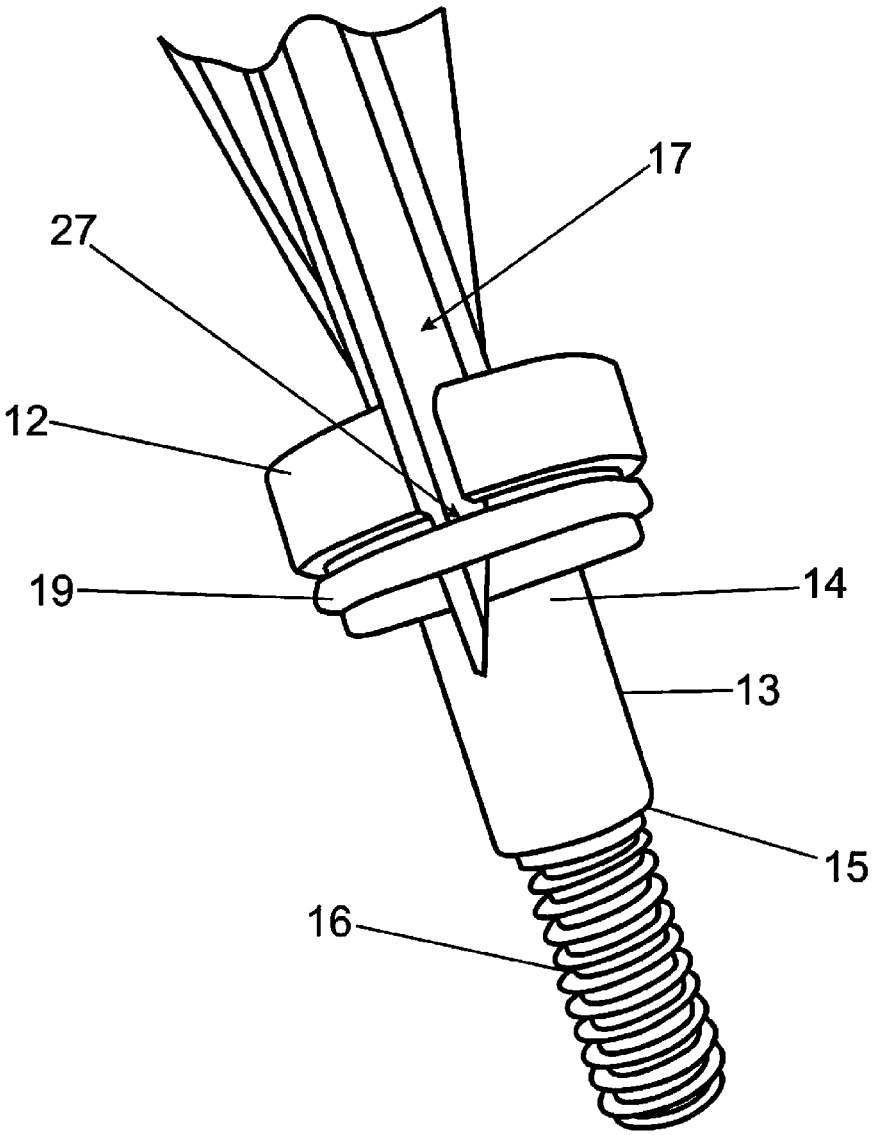
FIG. 5 is a side view of the blades being retained within the base by the blade retention band.
Figure 6:
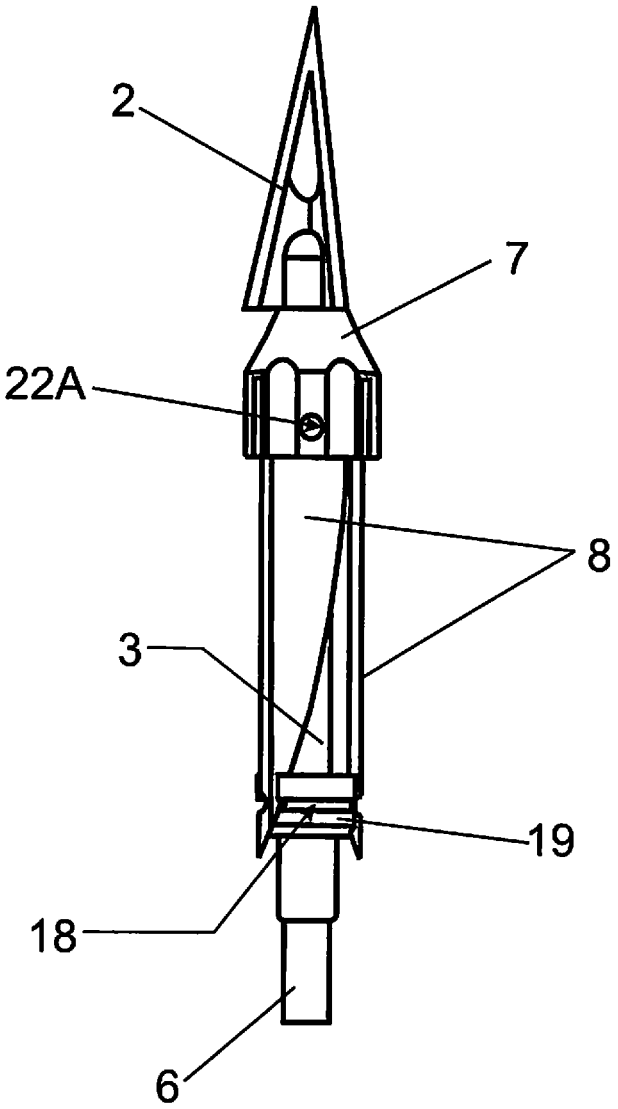
FIG. 6 is a side view of the arrowhead in its in-flight configuration.

Turning now to FIG. 5, it is noted that blade 8 is constructed with a predetermined length such when cutting blade second end 24 rests within blade retention slot 17, t blade retention band slot 27 corresponds with blade retention band groove 18. In this way, blade retention band 19 may rest within blade retention band groove 18 and blade retention band slot 27 such that blade 8 is captured and held against base 6. When this configuration is achieved, the arrowhead adopts the in-flight configuration as seen in FIG. 6. However, when target material is encountered and rearward force is applied to the blade carrier 7 the blade retention band will either slip rearward freeing blades 8 or be severed by the cutting force of the deploying blades 8.

I claim:

1. An arrowhead attached to an arrow, comprising:

a point, a resilient shaft comprised of materials selected from the group consisting of carbon fiber, nickel-titanium alloy, resilient plastics, said resilient shaft having a first resilient shaft end and a second resilient shaft end, said point attached to said first resilient shaft end, a base attached to said second resilient shaft end, a circumferential blade carrier slidably and rotatably disposed over said resilient shaft, a plurality of cutting blades pivotally mounted to said blade carrier.

2. The arrowhead of claim 1 wherein said resilient shaft is composed of a self-lubricating material.

3. The arrowhead of claim 1 wherein the point further comprises;

a plurality of point cutting blades comprised of steel, aluminum or titanium a shaft attachment mechanism attached to said cutting blades, said shaft attachment mechanism disposed over said point attachment mechanism.

4. The arrowhead of claim 3, wherein said base head further comprises;

a plurality of blade retentions slots, opposite said blade mounting slots in said circumferential blade carrier, a circumferential blade retention band groove, a base central bore wherein said second resilient shaft end is disposed, a resilient cutting blade retention band disposed within said circumferential blade retention band groove.

5. The arrowhead of claim 1 wherein the point further comprises a plurality of blades of a predetermined width whereby the cutting path created is substantially the width of the blade carrier allowing the blade carrier to move through target material with a minimal loss of kinetic energy.

6. The arrowhead of claim 1 wherein said blade carrier further comprises:

a circumferential blade carrier body comprised of steel, aluminum or titanium, a blade carrier central bore disposed through said blade carrier body, a plurality of blade mounting slots within said blade carrier body said blade further comprising blade mounting slot sidewalls said blade carrier slots laterally disposed to said blade carrier central bore, a pin bore disposed through said blade carrier slot sidewalls, a pivot mechanism disposed through said blade mounting slots.

7. The arrowhead of claim 6 wherein said pin bore is internally threaded.

8. The arrowhead of claim 6 wherein said circumferential blade carrier further comprises:

a blade carrier body having a ogive said ogive comprising a predetermined angle whereby said blade carrier body imparts blunt force to resistant target material, said blade carrier body having width that allows said blades to ride fully behind the blade carrier body, whereby aerodynamic interference is minimized.

9. The arrowhead of claim 1 wherein said blade carrier further comprises a circumferential blade carrier body having a ogive comprising an angle whereby said blade carrier body imparts and expanding force to resistant target material.

10. The arrowhead of claim 1 wherein said cutting blades are comprised of steel, aluminum or titanium and further comprise;

a cutting blade first end, a cutting blade second end, a cutting edge disposed between said cutting blade first end and said cutting blade second end, a spine opposite said cutting edge, a blade retention band slot disposed in said cutting edge substantially at near cutting blade second end, a pivot hole disposed through said cutting blade first end, said pivot mechanism disposed there through whereby said cutting blade may pivot within said blade mounting slots.

11. An arrowhead of claim 1 wherein said cutting blades are alternately disposed outward by pressure on the circumferential blade carrier and folded inward dependent on the resistance of the target material, whereby a greater cutting path is obtained.

12. An arrowhead of claim 1 wherein said resilient shaft in conjunction with said blade carrier retains maximum kinetic energy throughout its path through the target.

13. An arrowhead attached to an arrow, comprising:

a point, a resilient shaft having a first resilient shaft end and a second resilient shaft end, said point attached to said first resilient shaft end, a base attached to said second resilient shaft end, whereby when said point is deflected by resistant target material, said resilient shaft may bend around said hard target material and return to its original shape, a blade carrier slidably disposed over said resilient shaft, whereby said blade carrier may slide forward and rearward prior to and after said resilient shaft returns to its original shape, a plurality of cutting blades pivotally mounted to said blade carrier, whereby when said blade carrier moves rearward said plurality of cutting blades extend laterally and whereby said blades when extended laterally come into contact with resistant target material and are forced toward said resilient shaft in turn forcing said blade carrier forward.

14. An arrowhead attached to an arrow, comprising:

a point, a resilient shaft having a first resilient shaft end and a second resilient shaft end, said point attached to said first resilient shaft end, a base attached to said second resilient shaft end, a circumferential blade carrier slidably disposed over said resilient shaft, said blade carrier having an ogive of predetermined radius to allow maximum blunt force trauma and maximum outward force, and a plurality of cutting blades pivotally mounted to said blade carrier.

* * * * *